US012601533B2

(12) United States Patent
Cui et al.

(10) Patent No.: US 12,601,533 B2
(45) Date of Patent: Apr. 14, 2026

(54) REFRIGERATING AND FREEZING DEVICE

(71) Applicants: QINGDAO HAIER REFRIGERATOR CO., LTD., Qingdao (CN); HAIER SMART HOME CO., LTD., Qingdao (CN)

(72) Inventors: Zhanpeng Cui, Qingdao (CN); Jianquan Chen, Qingdao (CN); Tong Chen, Qingdao (CN); Lisheng Ji, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 144 days.

(21) Appl. No.: 18/568,149

(22) PCT Filed: Dec. 20, 2021

(86) PCT No.: PCT/CN2021/139646
§ 371 (c)(1),
(2) Date: Dec. 7, 2023

(87) PCT Pub. No.: WO2022/257415
PCT Pub. Date: Dec. 15, 2022

(65) Prior Publication Data

US 2024/0271853 A1 Aug. 15, 2024

(30) Foreign Application Priority Data

Jun. 7, 2021 (CN) ..... 202121263513.3

(51) Int. Cl.
*F25D 17/06* (2006.01)

(52) U.S. Cl.
CPC ..... *F25D 17/06* (2013.01); *F25D 2317/061* (2013.01); *F25D 2317/0654* (2013.01); *F25D 2317/0664* (2013.01)

(58) Field of Classification Search
CPC ..... F25D 17/06; F25D 2317/061; F25D 2317/0654; F25D 2317/0664;
(Continued)

(56) References Cited

FOREIGN PATENT DOCUMENTS

CN 106802375 A * 6/2017 ..... G01R 1/02
CN 107036361 A 8/2017
(Continued)

*Primary Examiner* — Kun Kai Ma
(74) *Attorney, Agent, or Firm* — Muncy, Geissler, Olds & Lowe, P.C.

(57) ABSTRACT

A refrigerating and freezing device including a cabinet, and an aging device for aging a to-be-aged material therein is provided in the cabinet. The aging device includes an outer housing and an inner housing provided in the outer housing, and an aging chamber for accommodating the to-be-aged material is defined in the inner housing; two transverse sides of the inner housing and two transverse sides of the outer housing are arranged at intervals to form two longitudinally extending air supply channels, and the air supply channels are communicated with the aging chamber through air supply ports formed in two transverse side plates of the inner housing. The aging device further includes a circulating fan for driving air flow in the two air supply channels to flow into the aging chamber through the air supply ports.

18 Claims, 4 Drawing Sheets

(58) Field of Classification Search
CPC ..... F25D 2317/0411; F25D 23/12; F25D 17/005; A23B 4/068
See application file for complete search history.

(56) References Cited

FOREIGN PATENT DOCUMENTS

| | | | | | |
|---|---|---|---|---|---|
| CN | 107044762 | A | | 8/2017 | |
| CN | 107300282 | A | | 10/2017 | |
| CN | 206771843 | U | | 12/2017 | |
| CN | 107782040 | A | | 3/2018 | |
| CN | 210596180 | U | * | 5/2020 | |
| CN | 112013592 | A | * | 12/2020 | ..... F25D 11/00 |
| CN | 212781010 | U | * | 3/2021 | |
| CN | 215206390 | U | * | 12/2021 | |
| JP | H0564688 | U | * | 8/1993 | |
| JP | 2002372361 | A | * | 12/2002 | ..... F25D 31/007 |
| JP | 2004239456 | A | | 8/2004 | |
| JP | 2007006820 | A | * | 1/2007 | |
| JP | 2010029080 | A | * | 2/2010 | |
| JP | 2019105434 | A | * | 6/2019 | |
| KR | 970004647 | Y1 | * | 5/1997 | ..... F25D 17/08 |
| KR | 20000010603 | A | * | 2/2000 | ..... A23B 7/152 |
| KR | 101734784 | B1 | * | 5/2017 | ..... F25D 7/1404 |
| KR | 20190001870 | A | * | 1/2019 | ..... F25D 17/067 |
| KR | 102330041 | B1 | * | 11/2021 | ..... G06K 7/1404 |

* cited by examiner

REFRIGERATING AND FREEZING DEVICE

TECHNICAL FIELD

The present utility model relates to a refrigerating and freezing technology, and in particular, to a refrigerating and freezing device.

BACKGROUND

Aging of meat and other foods not only has requirements for a temperature and a humidity, but also has certain requirements for a surface air speed. An existing aging device is generally independent, a special temperature control device and a special humidity control device are required to be designed, and air flow is required to be driven by a fan to circularly flow on a surface of the food, such that the surface of the food can be quickly dried by air at a certain temperature and humidity. However, when the food has a large volume, especially the meat which generally has a large volume, uneven air supply on the surface of the food tends to be caused, thus affecting an aging effect.

SUMMARY

An object of the present utility model is to overcome at least one of defects in a prior art and provide a refrigerating and freezing device having an aging function and a good aging effect.

A further object of the present utility model is to improve uniformity of air supply throughout an aging chamber.

Another object of the present utility model is to facilitate taking and placement of a to-be-aged material.

In order to achieve the above objects, the present utility model provides a refrigerating and freezing device.

In the refrigerating and freezing device according to the present utility model, the aging device is particularly provided in the cabinet thereof, such that a low-temperature high-humidity environment in the cabinet can be effectively utilized to promote aging of the to-be-aged material in the aging device, a special cooling device and a special humidifying device are not required, a cost is reduced, and functions of the refrigerating and freezing device are enriched. The aging device in the present utility model has the inner housing and the outer housing, the aging chamber is defined in the inner housing, and the two transverse sides of the inner housing and the two transverse sides of the outer housing are arranged at intervals to form the two air supply channels; under driving of the circulating fan, the air flow in the two air supply channels is sent to the aging chamber through the air supply ports formed in the two transverse side plates of the inner housing. That is, the air flow enters the aging chamber from both transverse sides of the aging chamber at the same time, which improves air supply uniformity of the air flow in a transverse direction of the aging chamber, thereby improving the aging effect of the to-be-aged material.

Further, in the present utility model, the uniformity of air supply throughout the aging chamber is improved by designing the size and/or the number of the air supply ports. Specifically, when the air supply ports have a same size, the plural air supply ports on each transverse side plate have an even arrangement density in the height direction of the inner housing, such that uniformity of air supply throughout the aging chamber in the height direction can be improved, thereby ensuring that both an upper surface and a lower surface of the to-be-aged material have a uniform air flow blowing effect. When the air supply ports have the same size, the plural air supply ports on each transverse side plate have a progressively increased arrangement density in the air flow direction in the air supply channel, such that a defect that a flow speed of the air flow in the air supply channel is decreased progressively in the air flow direction can be overcome by progressively increasing the arrangement density of the air supply ports, thereby improving uniformity of air supply throughput of the aging chamber in a longitudinal direction, and ensuring that regions of a surface of the to-be-aged material in the longitudinal direction have an uniform air flow blowing effect. Therefore, the to-be-aged material can have uniform air flow blowing effects in the transverse direction, the height direction and the longitudinal direction, thus improving the aging effect of the to-be-aged material.

Further, the outer housing of the aging device has a cylinder form, the inner housing has a drawer form, and the inner housing is provided in the outer housing in the pushable-and-pullable mode, such that the to-be-aged material can be conveniently placed to or taken from the aging chamber in the inner housing, thus improving convenience of an operation of a user.

The above and other objects, advantages and features of the present utility model will become more apparent to those skilled in the art from the following detailed description of specific embodiments thereof taken in conjunction with the accompanying drawings.

BRIEF DESCRIPTION OF THE DRAWINGS

Some specific embodiments of the utility model will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

Figure 1:
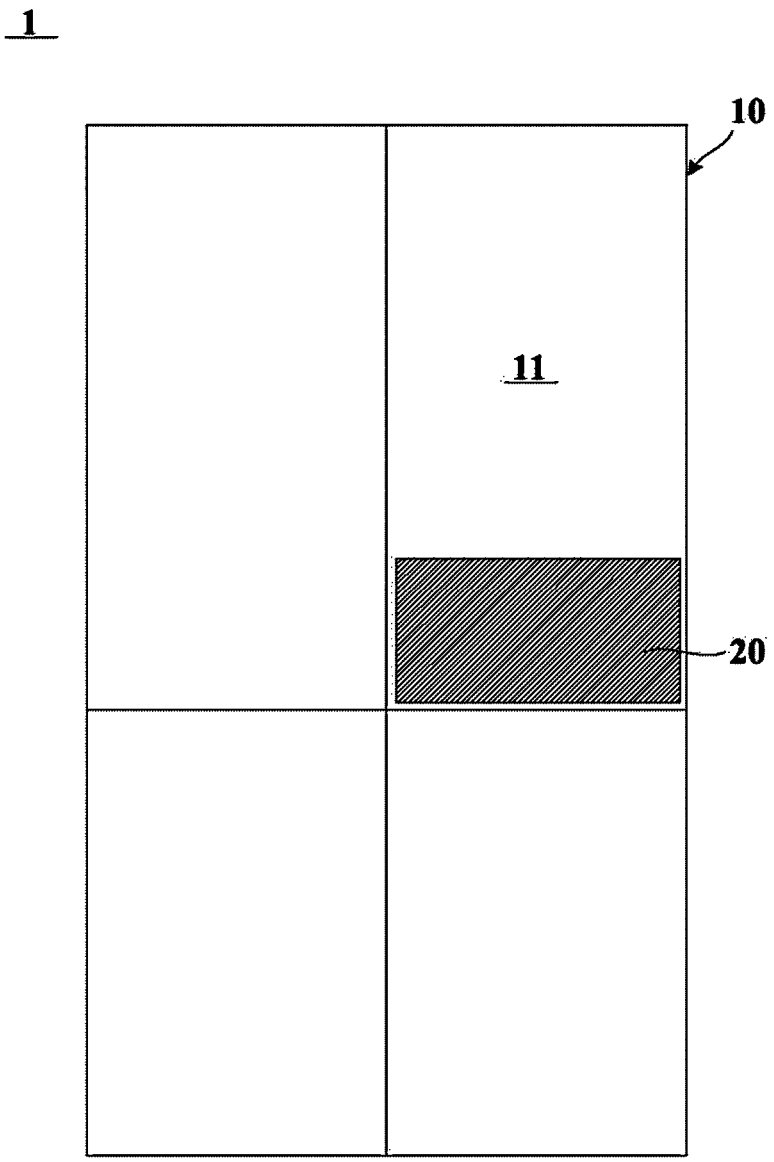
FIG. 1 is a schematic structural diagram of a refrigerating and freezing device according to an embodiment of the present utility model.

The present utility model provides a refrigerating and freezing device, and FIG. 1 is a schematic structural diagram of the refrigerating and freezing device according to an embodiment of the present utility model. The refrigerating and freezing device 1 according to the present utility model includes a cabinet 10, and an aging device 20 for aging a to-be-aged material therein is provided in the cabinet 10. Thus, a low-temperature high-humidity environment in the cabinet 10 can be effectively utilized to promote aging of the to-be-aged material in the aging device 20, and a special cooling device and a special humidifying device are not required, thus reducing a cost. The refrigerating and freezing device 1 integrating the aging device 20 not only has traditional storage and freshness retaining functions in a low-temperature environment, but also has an aging function, thus enriching functions of the refrigerating and freezing device 1.

Figure 2:
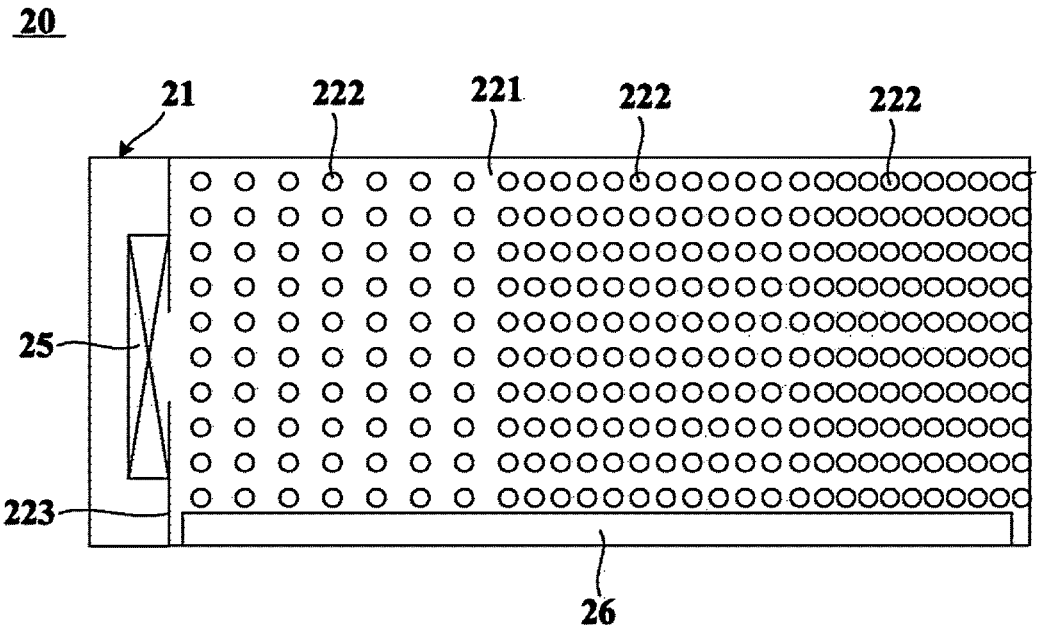
FIGS. 2 and 3 are schematic sectional diagrams of an aging device in the embodiment of the present utility model taken along vertical sections in different orientations.
Figure 3:
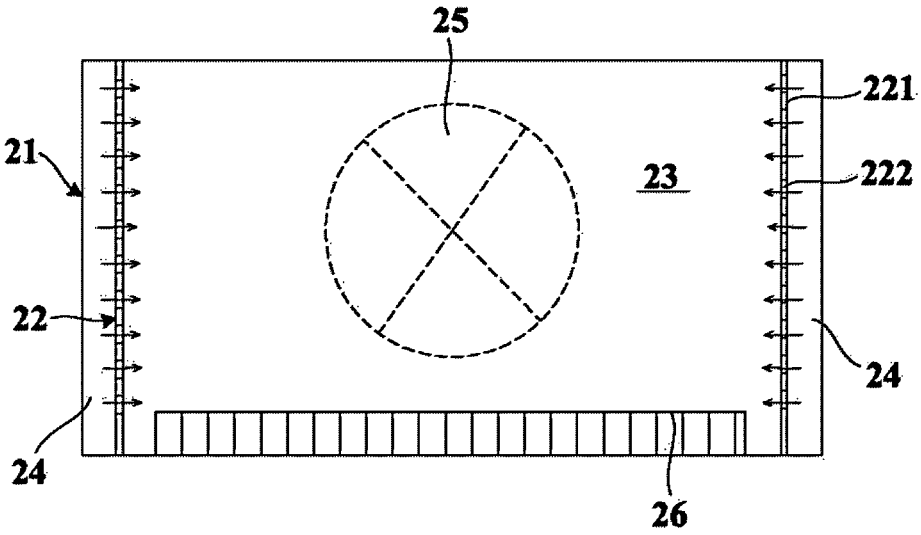
Figure 4:
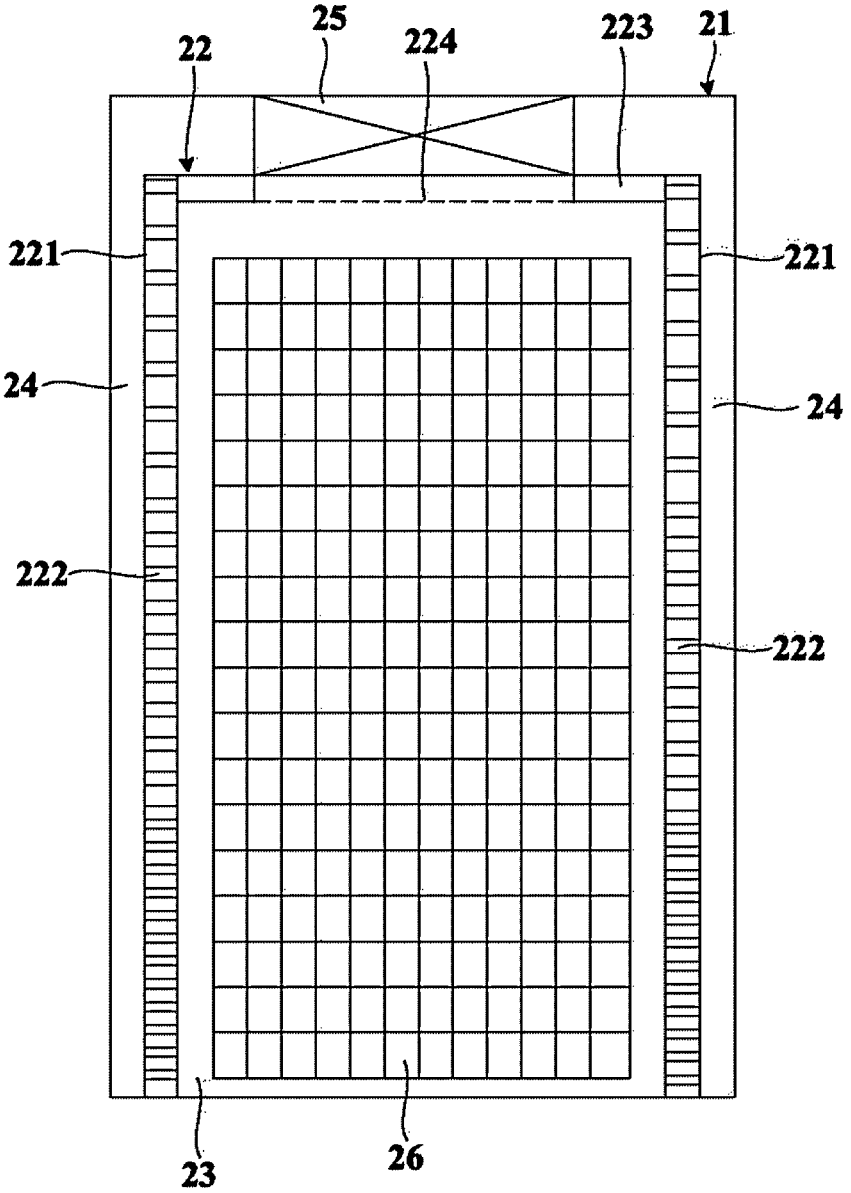
FIG. 4 is a schematic sectional diagram of the aging device in the embodiment of the present utility model taken along a horizontal section.
Figure 5:
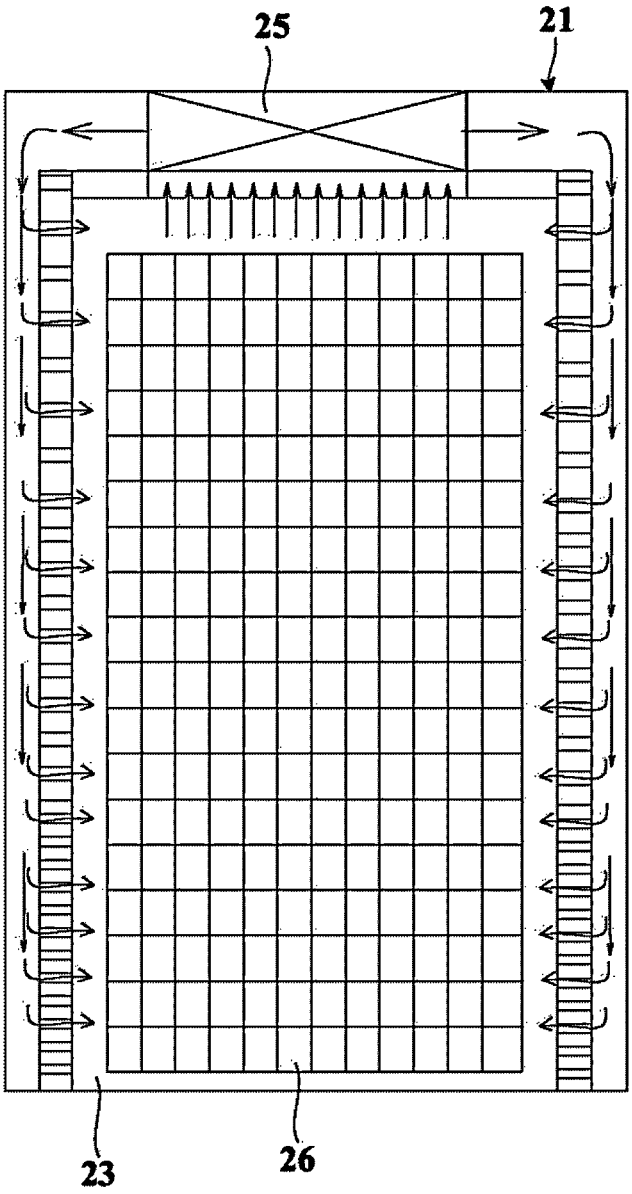
FIG. 5 is a schematic diagram of an air flow path in the aging device in the embodiment of the present utility model.

FIGS. 2 and 3 are schematic sectional diagrams of the aging device in the embodiment of the present utility model taken along vertical sections in different orientations, FIG. 4 is a schematic sectional diagram of the aging device in the embodiment of the present utility model taken along a horizontal section, and FIG. 5 is a schematic diagram of an air flow path in the aging device in the embodiment of the present utility model. Referring to FIGS. 2 to 5, the aging device 20 includes an outer housing 21 and an inner housing 22 provided in the outer housing 21, and an aging chamber 23 for accommodating the to-be-aged material is defined inside the inner housing 22. Two transverse sides of the inner housing 22 and two transverse sides of the outer housing 21 are arranged at intervals to form two longitudinally extending air supply channels 24, and each air supply channel 24 is located on a transverse outer side of the inner housing 22 and a transverse inner side of the outer housing 21. The longitudinal direction herein refers to a longitudinal direction of the inner housing 22 and the outer housing 21, and is perpendicular to a transverse direction thereof.

That is, a transverse side plate 221 on one side of the inner housing 22 is spaced apart from a transverse side wall of the outer housing 21 on the side, thereby forming one of the air supply channels 24; a transverse side plate 221 on the other side of the inner housing 22 is spaced apart from a transverse side wall of the outer housing 21 on the side, thereby forming the other air supply channel 24. The two air supply channels 24 are located on the two transverse outer sides of the inner housing 22 respectively and the two transverse inner sides of the outer housing 21 respectively, and the two air supply channels 24 extend in the longitudinal direction of the inner housing 22.

Further, the air supply channels 24 are communicated with the aging chamber 23 through air supply ports 222 formed in the two transverse side plates 221 of the inner housing 22. The aging device 20 further includes a circulating fan 25 for driving air flow in the two air supply channels 24 to flow into the aging chamber 23 through the air supply ports 222.

The aging device in the present utility model has the inner housing 22 and the outer housing 21, the aging chamber 23 is defined in the inner housing 22, and the two transverse sides of the inner housing 22 and the two transverse sides of the outer housing 21 are arranged at intervals to form the two air supply channels 24. Under driving of the circulating fan 25, the air flow in the two air supply channels 24 is sent to the aging chamber 23 through the air supply ports 222 formed in the two transverse side plates 221 of the inner housing 22. That is, the air flow enters the aging chamber 23 from both transverse sides of the aging chamber 23 at the same time, which improves air supply uniformity of the air flow in a transverse direction of the aging chamber 23, thereby improving an aging effect of the to-be-aged material.

In some embodiments, plural air supply ports 222 are provided, and a number and/or sizes of the plural air supply ports 222 are set such that the air flow supplied to all positions of the aging chamber 23 is uniform, thus further improving the aging effect of the to-be-aged material.

Specifically, plural air supply ports 222 are formed on each of the transverse side plates 221 of the inner housing 22. The plural air supply ports 222 on the two transverse side plates 221 may be symmetrically arranged.

Further, the air supply ports 222 have a same size, and the plural air supply ports 222 on each transverse side plate 221 have an even arrangement density in a height direction of the inner housing 22. The plural air supply ports 222 on the two transverse side plates 221 have a same arrangement density in the height direction of the inner housing 22. Thus, uniformity of air supply throughout the aging chamber 23 in the height direction can be improved, thereby ensuring that both an upper surface and a lower surface of the to-be-aged material have a uniform air flow blowing effect, and improving the aging effect of the to-be-aged material.

Specifically, the plurality of air supply ports 222 on the same transverse side plate 221 may be arranged in a plurality of rows and columns, and the air supply ports 222 adjacent in the height direction have a same hole distance.

The applicant recognizes that the same circulating fan 25 is utilized to drive the air flow in the two air supply channels 24 to flow towards the aging chamber 23 at the same time, and the circulating fan 25 is certainly located upstream of the two air supply channels 24. Therefore, a flow speed of the air flow is gradually decreased in an air flow direction in the air supply channel 24 (i.e., the longitudinal direction of the inner housing 22). Therefore, when the air supply ports 222 have the same size, the arrangement density of the plurality of air supply ports 222 on each of the transverse side plates 221 in the air flow direction in the air supply channel 24 is stepwise or gradually increased.

Thus, a defect that the flow speed of the air flow in the air supply channel 24 is decreased progressively in the air flow direction can be overcome by progressively increasing the arrangement density of the air supply ports 222, thereby improving uniformity of air supply throughput of the aging chamber 23 in the longitudinal direction, ensuring that regions of a surface of the to-be-aged material in the longitudinal direction have an uniform air flow blowing effect, and improving the aging effect of the to-be-aged material.

In an embodiment, the arrangement density of the plurality of air supply ports 222 on the transverse side plate 221 is increased stepwise in the air flow direction in the air supply channel 24. That is, the transverse side plate 221 may be divided into a plurality of sections in the longitudinal direction, the arrangement density of the air supply ports 222 in each section in the air flow direction is the same, and the arrangement densities of the air supply ports 222 in the plurality of sections arranged in sequence along the air flow direction is gradually increased. Specifically, the plurality of air supply ports 222 on the same transverse side plate 221 may be arranged in a plurality of rows and columns, and the air supply ports 222 adjacent in the air flow direction in the same section have a same hole distance. The air supply ports 222 adjacent in the longitudinal direction of the inner housing in the plurality of sections arranged in sequence along the air flow direction have gradually increased hole distances.

In another embodiment, the arrangement density of the plurality of air supply ports 222 on the transverse side plate 221 is increased gradually in the air flow direction in the air supply channel 24. That is, a degree of the increase in the arrangement density of the air supply ports 222 in the air flow direction is uniform. Specifically, the plurality of air supply ports 222 on the same transverse side plate 221 may be arranged in a plurality of rows and columns, and the hole distances between the air supply ports 222 adjacent in the air flow direction are increased at an equal distance.

Therefore, in the present application, by specially designing the air supply channel 24 and the air supply port 222, the to-be-aged material can have uniform air flow blowing effects in the transverse direction, the height direction and the longitudinal direction, and the to-be-aged material has a good aging effect.

In some embodiments, an end plate 223 of the inner housing 22 connected between the two transverse side plates 221 is provided with an air return port 224 for allowing the air flow in the aging chamber 23 to flow to the outside of the inner housing 22. The circulating fan 25 is provided between the outer housing 21 and the inner housing 22, an air flow inlet of the circulating fan 25 is communicated with the air return port 224, and an air flow outlet of the circulating fan 25 is communicated with the two air supply channels 24.

Thus, the air flow flowing into the aging chamber 23 can flow through a long path in the aging chamber 23 and then flow out from the air return port 224, the air flow is blown over a surface of the to-be-aged material for a long time, and an air drying effect of the air flow on the to-be-aged material is sufficiently exerted.

In some embodiments, the air return port 224 is formed in a rear end plate of the inner housing 22 on a rear side of the cabinet 10, and the circulating fan 25 is fixed to an outer side of the rear end plate. That is, when the aging device 20 is placed in the cabinet 10, the circulating fan 25 is located on the rear side of the cabinet 10, and a user is less likely to experience noise generated when the circulating fan 25 runs.

In some embodiments, the circulating fan 25 is configured as a centrifugal fan with unidirectional air supply and bidirectional air discharge. Therefore, air flow of the air return port 224 can be blown to the two air supply channels 24 in two opposite directions, and a space occupied by the circulating fan 25 is reduced, such that the aging device 20 has a more compact structure and a smaller volume, thereby avoiding occupying a too large space in the cabinet 10.

In some embodiments, the outer housing 21 is configured as a cylinder with a front opening. The inner housing 22 is configured as a drawer with an open top, and the inner housing 22 is provided in the outer housing 21 in a pushable-and-pullable mode.

That is, the outer housing 21 of the aging device 20 has a cylinder form, the inner housing 22 has a drawer form, and the inner housing 22 is provided in the outer housing 21 in the pushable-and-pullable mode, such that the to-be-aged material can be conveniently placed to or taken from the aging chamber 23 in the inner housing 22, thus improving convenience of an operation of the user.

In some embodiments, a storage net rack 26 for placing the to-be-aged material is provided in the inner housing 22, the storage net rack 26 has a plurality of hollowed meshes, and the storage net rack 26 is spaced apart from a bottom plate of the inner housing 22.

That is, certain spaces exist above and below the storage net rack 26, and the storage net rack 26 is hollowed, such that the air flow can be blown over the upper surface and the lower surface of the to-be-aged material placed on the storage net rack 26 at the same time, thereby ensuring that the upper surface and the lower surface of the to-be-aged material can reach an air drying effect as soon as possible.

The hollowed storage net rack 26 further reduces a contact area between the to-be-aged material and the storage net rack 26, thus avoiding that a part of the surface of the to-be-aged material cannot be in contact with the air flow and thus spoils.

In some embodiments, a refrigerating chamber 11 for storing articles is defined in the cabinet 10, and the aging device 20 is provided in the refrigerating chamber 11. A storage temperature of the refrigerating chamber 11 usually ranges from 0° C. to 8° C., and is suitable for a requirement for an aging temperature of the to-be-aged material. A storage humidity in the refrigerating chamber 11 is usually higher than a humidity of an indoor environment, and is suitable for a requirement for an aging humidity of the to-be-aged material. The humidity in the aging device 20 can be conveniently adjusted by the air flow in the refrigerating chamber 11 even when the humidity is improper. Therefore, by providing the aging device 20 in the refrigerating chamber 11, temperature and humidity conditions of the refrigerating chamber 11 can be fully utilized, thus reducing the cost to the maximum extent.

Further, the cabinet 10 may further define a freezing chamber and/or a variable temperature chamber. The refrigerating chamber 11, the freezing chamber, and the variable temperature chamber are selectively opened or closed by doors pivotably provided on a front side of the cabinet 10 respectively.

It should be appreciated by those skilled in the art that the refrigerating and freezing device 1 according to the present utility model may be configured as a cross side-by-side refrigerator, and the aging device 20 is provided in one upper refrigerating chamber.

In some other embodiments, the refrigerating and freezing device 1 may not be limited to the refrigerator structure shown in FIG. 1, but may be configured as a double-door refrigerator, and the aging device 20 is provided in the upper refrigerating chamber.

In some other embodiments, the refrigerating and freezing device 1 may not be limited to the refrigerator structure shown in FIG. 1, but may be configured as a three-door refrigerator, and the aging device 20 is provided in the upper refrigerating chamber.

In some other embodiments, the refrigerating and freezing device 1 may not be limited to the refrigerator structure shown in FIG. 1, but may be configured as a side-by-side refrigerator, and the aging device 20 is provided in a compartment with a refrigerating storage environment.

In some other embodiments, the refrigerating and freezing device 1 may not be limited to the refrigerator structure shown in FIG. 1, but may be configured as a freezer, a horizontal freezer, or various special-shaped refrigerating and freezing devices, and the aging device 20 is provided in a space having a refrigerating storage environment.

It should also be understood by those skilled in the art that the terms "upper", "lower", "front", "rear", "top", "bottom", or the like, used in the embodiments of the present utility model are used as terms for indicating the orientation or the positional relationship with respect to the actual use state of the refrigerating and freezing device 1, and these terms are only used for convenience of description and understanding of the technical solution of the present utility model, and do not indicate or imply that the device or the component referred to must have a specific orientation, be configured and operated in a specific orientation, and therefore, should not be construed as limiting the present utility model.

So far, it should be appreciated by those skilled in the art that while various exemplary embodiments of the utility model have been shown and described in detail herein, many other variations or modifications which are consistent with the principles of this utility model may be determined or derived directly from the disclosure of the present utility model without departing from the spirit and scope of the utility model. Accordingly, the scope of the utility model should be understood and interpreted to cover all such other variations or modifications.

What is claimed is:

1. A refrigerating and freezing device, comprising a cabinet, wherein an aging device for aging a to-be-aged material therein is provided in the cabinet, the aging device comprises an outer housing and an inner housing provided in the outer housing, and an aging chamber for accommodating the to-be-aged material is defined in the inner housing; two transverse sides of the inner housing and two transverse sides of the outer housing are arranged at intervals to form two longitudinally extending air supply channels, and the two longitudinally extending air supply channels are communicated with the aging chamber through air supply ports formed in two transverse side plates of the inner housing; and the aging device further comprises a circulating fan for driving air flow in the two longitudinally extending air supply channels to flow into the aging chamber through the air supply ports;

wherein the outer housing is configured as a cylinder with a front opening; and the inner housing is configured as a drawer with an open top, and the inner housing is provided in the outer housing in a pushable-and-pullable mode.

2. The refrigerating and freezing device according to claim 1, wherein plural air supply ports are provided; and a number and/or sizes of the plurality of air supply ports are set such that amounts of air flow supplied to all positions of the aging chamber are uniform.

3. The refrigerating and freezing device according to claim 2, wherein the air supply ports have a same size; and the plurality of air supply ports on each transverse side plate has an even arrangement density in a height direction of the inner housing.

4. The refrigerating and freezing device according to claim 2, wherein the air supply ports have a same size; and the arrangement density of the plurality of air supply ports on each transverse side plate in an air flow direction in the two longitudinally extending air supply channels is increased stepwise or gradually.

5. The refrigerating and freezing device according to claim 1, wherein an end plate of the inner housing connected between the two transverse side plates is provided with an air return port for allowing the air flow in the aging chamber to flow to the outside of the inner housing; and the circulating fan is provided between the outer housing and the inner housing, an air flow inlet of the circulating fan is communicated with the air return port, and an air flow outlet of the circulating fan is communicated with the two longitudinally extending air supply channels.

6. The refrigerating and freezing device according to claim 5, wherein the air return port is formed in a rear end plate of the inner housing on a rear side of the cabinet, and the circulating fan is fixed to an outer side of the rear end plate.

7. The refrigerating and freezing device according to claim 1, wherein the circulating fan is configured as a centrifugal fan with unidirectional air supply and bidirectional air discharge.

8. The refrigerating and freezing device according to claim 1, wherein a storage net rack for placing the to-be-aged material is provided in the inner housing, and the storage net rack has a plurality of hollowed meshes; and the storage net rack is spaced apart from a bottom plate of the inner housing.

9. The refrigerating and freezing device according to claim 1, wherein a refrigerating chamber for storing articles is defined in the cabinet, and the aging device is provided in the refrigerating chamber.

10. A refrigerating and freezing device, comprising a cabinet, wherein an aging device for aging a to-be-aged material therein is provided in the cabinet, the aging device comprises an outer housing and an inner housing provided in the outer housing, and an aging chamber for accommodating the to-be-aged material is defined in the inner housing; two transverse sides of the inner housing and two transverse sides of the outer housing are arranged at intervals to form two longitudinally extending air supply channels, and the two longitudinally extending air supply channels are communicated with the aging chamber through air supply ports formed in two transverse side plates of the inner housing; and the aging device further comprises a circulating fan for driving air flow in the two longitudinally extending air supply channels to flow into the aging chamber through the air supply ports;

wherein a refrigerating chamber for storing articles is defined in the cabinet, and the aging device is provided in the refrigerating chamber.

11. The refrigerating and freezing device according to claim 10, wherein plural air supply ports are provided; and a number and/or sizes of the plurality of air supply ports are set such that amounts of air flow supplied to all positions of the aging chamber are uniform.

12. The refrigerating and freezing device according to claim 11, wherein the air supply ports have a same size; and the plurality of air supply ports on each transverse side plate has an even arrangement density in a height direction of the inner housing.

13. The refrigerating and freezing device according to claim 11, wherein the air supply ports have a same size; and the arrangement density of the plurality of air supply ports on each transverse side plate in an air flow direction in the two longitudinally extending air supply channels is increased stepwise or gradually.

14. The refrigerating and freezing device according to claim 10, wherein an end plate of the inner housing connected between the two transverse side plates is provided with an air return port for allowing the air flow in the aging chamber to flow to the outside of the inner housing; and the circulating fan is provided between the outer housing and the inner housing, an air flow inlet of the circulating fan is communicated with the air return port, and an air flow outlet of the circulating fan is communicated with the two longitudinally extending air supply channels.

15. The refrigerating and freezing device according to claim 14, wherein the air return port is formed in a rear end plate of the inner housing on a rear side of the cabinet, and the circulating fan is fixed to an outer side of the rear end plate.

16. The refrigerating and freezing device according to claim 10, wherein the circulating fan is configured as a centrifugal fan with unidirectional air supply and bidirectional air discharge.

17. The refrigerating and freezing device according to claim 10, wherein the outer housing is configured as a cylinder with a front opening; and the inner housing is configured as a drawer with an open top, and the inner housing is provided in the outer housing in a pushable-and-pullable mode.

18. The refrigerating and freezing device according to claim 10, wherein a storage net rack for placing the to-be-aged material is provided in the inner housing, and the storage net rack has a plurality of hollowed meshes; and the storage net rack is spaced apart from a bottom plate of the inner housing.

* * * * *